US011566794B2

(12) United States Patent
Lee et al.

(10) Patent No.: US 11,566,794 B2
(45) Date of Patent: Jan. 31, 2023

(54) AIR CONDITIONER

(71) Applicant: Samsung Electronics Co., Ltd., Suwon-si (KR)

(72) Inventors: Jang Jung Lee, Hwaseong-si (KR); Hyun-Ho Kim, Suwon-si (KR); Hong Yeol Moon, Hwaseong-si (KR); Chul Byung Park, Ansan-si (KR); Hyeon U Park, Suwon-si (KR); Seung-Jun Yoon, Suwon-si (KR); Jei Min Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 266 days.

(21) Appl. No.: 15/963,486

(22) Filed: Apr. 26, 2018

(65) Prior Publication Data

US 2018/0313552 A1 Nov. 1, 2018

(30) Foreign Application Priority Data

Apr. 28, 2017 (KR) ..... 10-2017-0055641

(51) Int. Cl.
*F24F 1/0011* (2019.01)
*F24F 13/14* (2006.01)
*F24F 1/0047* (2019.01)

(52) U.S. Cl.
CPC ..... *F24F 1/0011* (2013.01); *F24F 1/0047* (2019.02); *F24F 13/14* (2013.01)

(58) Field of Classification Search
CPC ..... F24F 1/0011; F24F 1/0047; F24F 13/14; F24F 13/1426; F24F 13/1486; F24F 2013/1433

(Continued)

(56) References Cited

U.S. PATENT DOCUMENTS 3,147,768 A * 9/1964 Kennedy ..... F24F 13/1413 137/614.11
3,986,850 A * 10/1976 Wilcox ..... E04B 9/02 55/355

(Continued)

FOREIGN PATENT DOCUMENTS

CN 104697055 6/2015
CN 105180267 12/2015

(Continued)

OTHER PUBLICATIONS

International Search Report dated Aug. 24, 2018 in International Patent Application No. PCT/KR2018/004564.

(Continued)

*Primary Examiner* — Edelmira Bosques
*Assistant Examiner* — Frances F. Hamilton
(74) *Attorney, Agent, or Firm* — Staas & Halsey LLP

(57) ABSTRACT

Disclosed herein are an air conditioner includes a housing having an outlet, and a blade configured to open and close the outlet and having a plurality of holes. The blade includes a first side extending in a first direction, a second side extending in a second direction, and a block area in which none of the plurality of holes are formed, at least a number of the plurality of holes are disposed on a first line extending in the first direction, and a second line spaced in the second direction from the first line, respectively, where the second line extends in the first direction, and the block area comprises an area formed in the first direction between the first line and the second line.

20 Claims, 12 Drawing Sheets

(58) Field of Classification Search
USPC ..... 454/297
See application file for complete search history.

(56) References Cited

U.S. PATENT DOCUMENTS

| | | | | | |
|---|---|---|---|---|---|
| 4,548,068 | A * | 10/1985 | Gualtieri | B01D 46/0005 454/297 |
| 5,103,869 | A * | 4/1992 | Kimura | F24F 13/12 137/625.28 |
| 6,019,677 | A * | 2/2000 | Demster | F24F 13/068 454/290 |
| 7,140,426 | B2 * | 11/2006 | Huebner | F24F 5/0092 165/170 |
| 10,113,765 | B1 * | 10/2018 | May | F24F 11/74 |
| 2015/0007967 | A1 | 1/2015 | Jeong et al. | |
| 2017/0016633 | A1 | 1/2017 | Jeon et al. | |
| 2018/0119984 | A1 * | 5/2018 | Cho | F24F 13/14 |
| 2018/0274814 | A1 * | 9/2018 | Cho | F24F 13/14 |
| 2019/0056120 | A1 * | 2/2019 | Cho | F24F 13/20 |

FOREIGN PATENT DOCUMENTS

| | | | | |
|---|---|---|---|---|
| CN | 105180267 | A * | 12/2015 | |
| CN | 204901976 | U | 12/2015 | |
| CN | 106369791 | | 2/2017 | |
| CN | 206073274 | | 4/2017 | |
| CN | 206094306 | | 4/2017 | |
| CN | 206094306 | U * | 4/2017 | |
| CN | 107842932 | | 3/2018 | |
| CN | 107842932 | A * | 3/2018 | |
| EP | 0924475 | A1 * | 6/1999 | F24F 13/1486 |
| JP | 2001-304674 | | 10/2001 | |
| JP | 2002-98397 | | 4/2002 | |
| JP | 2005-90851 | | 4/2005 | |
| JP | 2006-177603 | | 7/2006 | |
| KR | 2001-0001931 | | 1/2001 | |
| KR | 10-2010-0007259 | | 1/2010 | |
| KR | 10-2010-0007303 | | 1/2010 | |
| KR | 10-2012-0075996 | | 7/2012 | |
| WO | WO-2010021383 | A1 * | 2/2010 | F24F 13/15 |
| WO | 2017/024638 | A1 | 2/2017 | |
| WO | WO-2017024638 | A1 * | 2/2017 | |
| WO | WO-2019050213 | A1 * | 3/2019 | F24F 13/14 |

OTHER PUBLICATIONS

Extended European Search Report dated Feb. 28, 2020 in European Application No. 18791650.7.
Chinese Office Action dated Oct. 12, 2020 in Chinese Patent Application No. 201880028114.3.
Chinese Office Action dated Apr. 22, 2021 in Chinese Patent Application No. 201880028114.3.
Chinese Office Action dated Sep. 27, 2021 in Chinese Patent Application No. 201880028114.3.
Korean Office Action dated Sep. 16, 2021 in Korean Patent Application No. 10-2017-0055641.
European Office Action dated Feb. 2, 2022 in European Patent Application No. 18 791 650.7 (4 pages).
Korean Notice of Allowance dated Feb. 18, 2022 in Korean Patent Application No. 10-2017-0055641 (2 pages; 1 page English translation).

* cited by examiner

AIR CONDITIONER

CROSS-REFERENCE TO RELATED APPLICATION

This application is based on and claims priority under 35 U.S.C. § 119 to Korean Patent Application No. 10-2017-0055641, filed on Apr. 28, 2017, in the Korean Intellectual Property Office, the disclosure of which is incorporated by reference herein in its entirety.

BACKGROUND

1. Field

The present disclosure relates to an air conditioner, and more particularly, an air conditioner with an improved structure.

2. Description of the Related Art

In general, an air conditioner is an electronic appliance for maintaining indoor air at pleasant temperature using a cooling cycle of refrigerants. The air conditioner includes an indoor unit, an outdoor unit, and a refrigerant pipe, wherein the indoor unit includes a heat exchanger, a blower fan, etc. and is installed indoor, the outdoor unit includes a heat exchanger, a blower fan, a compressor, a condenser, etc. and is installed outdoor, and the refrigerant pipe connects the indoor unit to the outdoor unit and circulates refrigerants.

The air conditioner can be classified into a stand type air conditioner in which an indoor unit is installed on the floor, a wall-mounted air conditioner in which an indoor unit is mounted on a wall, and a ceiling type air conditioner in which an indoor unit is mounted on a ceiling, according to places where the indoor unit is installed. In the ceiling type air conditioner, the indoor unit is embedded into or hung on the ceiling.

Since the indoor unit of the ceiling type air conditioner is mounted on the ceiling, an inlet for inhaling indoor air, and an outlet for discharging air heat-exchanged through the heat exchanger to the indoor space are disposed in the lower part of the main body. The indoor unit of the ceiling type air conditioner can be classified into a 1-way type with a single outlet and a 4-way type with four outlets forming a quadrangle, according to the number of outlets.

Generally, the indoor unit of the air conditioner includes a blade for adjusting a direction in which heat-exchanged air is discharged, in the outlet. The blade is rotatably coupled with one part of the outlet. Also, the blade is coupled with a motor at one end, and receives a rotatory force generated by the motor to rotate.

SUMMARY

Therefore, it is an aspect of the present disclosure to provide an air conditioner capable of performing various air-conditioning methods, wherein air is discharged through a plurality of holes formed in a blade when the blade closes an outlet.

It is another aspect of the present disclosure to provide an air conditioner capable of discharging air through a plurality of holes with high discharge efficiency.

Additional aspects of the disclosure will be set forth in part in the description which follows and, in part, will be obvious from the description, or may be learned by practice of the disclosure.

In accordance with an aspect of the present disclosure, an air conditioner includes a housing including an outlet, and a blade configured to open and close the outlet and having a plurality of holes, and the blade comprises a first side extending in a first direction, a second side extending in a second direction, and a block area in which none of the plurality of holes are formed, where the first side is longer than the second side and at least a number of the plurality of holes are disposed along a first line extending in the first direction, and a second line spaced in the second direction from the first line, respectively, and the second line extends in the first direction, and the block area comprises an area formed in the first direction between the first line and the second line.

The area comprised in the block area is a first block area, and the first block area is formed throughout an area formed between the first line and the second line.

None of the plurality of holes are formed in the first block area that is formed between the first line and the second line.

The first line and the second line are formed in a straight line.

The first line and the second line are formed in parallel to the first side.

At least the number of the plurality of holes are formed on a first column extending in the second direction, and a second column spaced in the first direction from the first column and extending in the second direction, respectively, and the first column and the second column extend in zigzags.

The block area comprises a second block area formed in the second direction between the first column and the second column, and the second block area comprises a plurality of bending portions bent in the first direction or in an opposite direction of the first direction.

The plurality of bending portions include a plurality of first bending portions bent in the first direction, and a plurality of second bending portions bent in the opposite direction of the first direction, and the plurality of first bending portions and the plurality of second bending portions are arranged alternately in the second direction.

The first block area extends in parallel to the first direction.

The air conditioner further includes a rib protruding in a third direction that is perpendicular to the first direction and the second direction, and the rib is coupled with the housing, and the rib protrudes from the inside of the second block area.

The rib comprises a contact portion contacting the blade, a rib body protruding in the third direction from the contact portion, and a coupling portion extending from one side of the rib body and coupled with the housing, and the rib body is disposed in the third direction in the inside of the second block area.

The contact portion is formed along the second block area.

The contact portion is formed outside a direction in which air is to be discharged through the plurality of holes.

The rib body extends in the third direction in correspondence to the plurality of bending portions with respect to the first direction and the second direction.

When the blade is at an open position, the blade guides air to be discharged through the outlet, and when the blade is at a closed position, the blade enables air to be discharged through the plurality of holes.

In accordance with other aspect of the present disclosure, an air conditioner includes a housing including an outlet, and a blade configured to open and close the outlet, and the blade includes a plurality of holes, and a first side extending in a first direction, and a second side extending in a second direction, and a first hole among the plurality of holes is spaced from a second hole located closest to the first hole, with respect to the second direction.

A third hole among the plurality of holes overlaps with a fourth hole among the plurality of holes that is located closest to the third hole, with respect to the first direction.

The first hole overlaps with the second hole with respect to the first direction.

The air conditioner further includes rib protruding in a third direction that is perpendicular to the first direction and the second direction, the rib is coupled with the housing, the rib protrudes in the third direction without overlapping with the plurality of holes.

In accordance with one aspect of the present disclosure, an air conditioner includes a housing including an outlet, and a blade configured to open and close the outlet and including a plurality of holes, a first side extending in a first direction, a second side extending in second direction, and a block area in which none of the plurality of holes are disposed. At least a part of the plurality of holes are disposed along a first line extending in the first direction and a second line spaced in the second direction from the first line, respectively, and the second line extends in the first direction. The at least number of the plurality of holes are disposed along a first column formed toward the second direction, and a second column spaced in the first direction from the first column, respectively, and the second column is formed toward the second direction, and the first line and the second line are formed in a straight line, and the first column and the second column are formed in zigzags.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
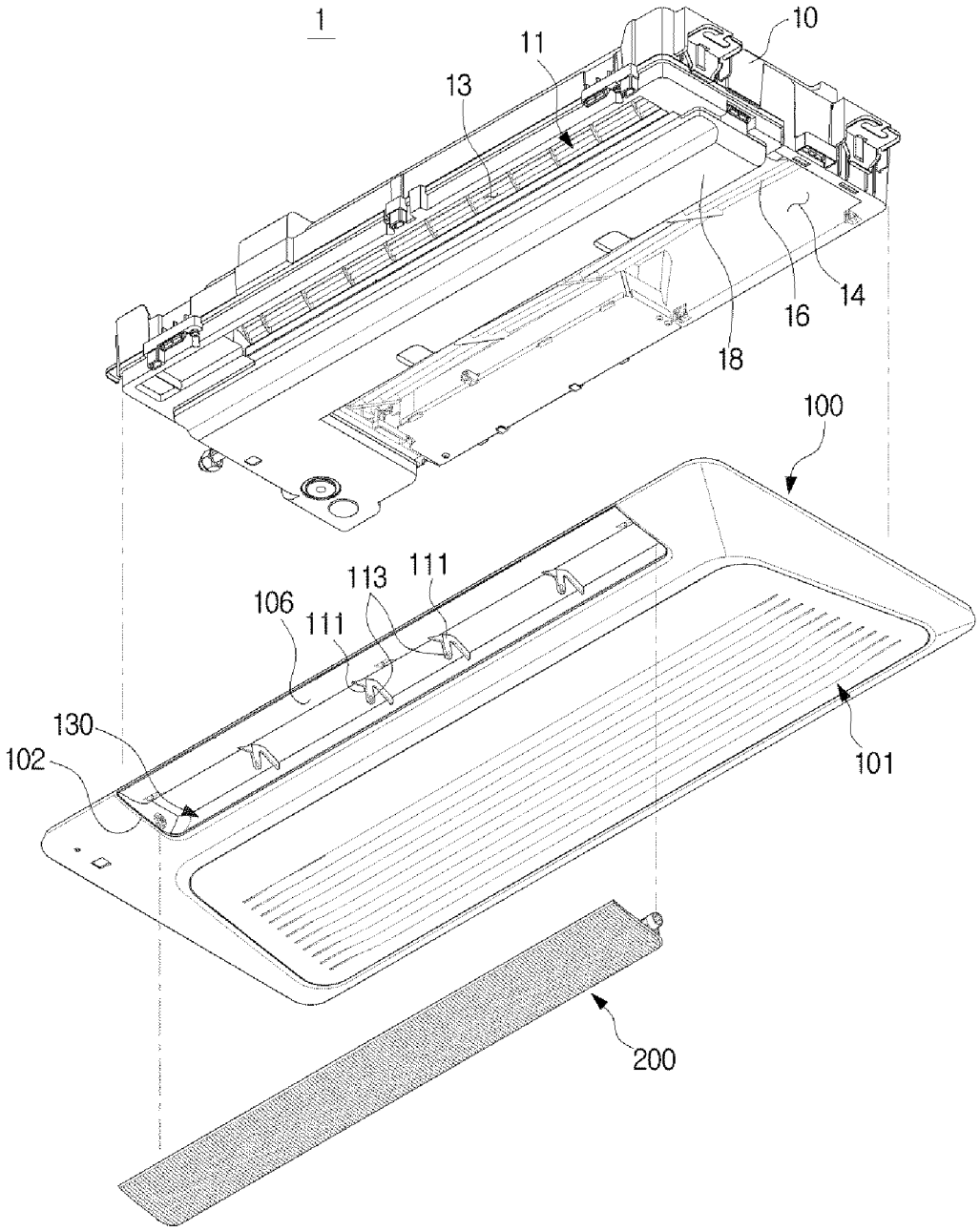
FIG. 1 is an exploded perspective view of a part of an air conditioner according to an embodiment of the present disclosure

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

Also, it will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front", "upper", "lower", "left", and "right" are defined based on the drawings, and the shapes and positions of the components are not limited by the terms.

A cooling cycle constituting an air conditioner may be configured with a compressor, a condenser, an expansion valve, and an evaporator. The cooling cycle may perform a series of processes of compression-condensation-expansion-evaporation so as to heat-exchange air with refrigerants and then supply air-conditioned air.

The compressor may compress refrigerant gas to a high-temperature, high-pressure state, and discharge the compressed refrigerant gas to the condenser. The condenser may condense the compressed refrigerant gas to a liquid state, and emit heat to the surroundings during the condensing process.

The expansion valve may expand the liquid-state refrigerants in the high-temperature, high-pressure state condensed by the condenser to liquid-state refrigerants in a low-pressure state. The evaporator may evaporate the refrigerants expanded by the expansion valve, and return the refrigerant gas in the low-temperature, low-pressure state to the compressor. The evaporator may achieve a cooling effect through heat-exchange with an object to be cooled using evaporative latent heat of refrigerants. Through the cycle, the air conditioner can adjust the temperature of indoor space.

An outdoor unit of the air conditioner may be a part of the cooling cycle, configured with the compressor and an outdoor heat exchanger. An indoor unit of the air conditioner may include an indoor heat exchanger, and the expansion valve may be installed in any one of the indoor unit and the outdoor unit. The indoor heat exchanger and the outdoor heat exchanger may function as a condenser or an evaporator. When the indoor heat exchanger is used as a condenser, the air conditioner may function as a heater, and when the indoor heat exchanger is used as an evaporator, the air conditioner may function as a cooler.

Hereinafter, the embodiments of the present disclosure will be described in detail with reference to the accompanying drawings.

Also, hereinafter, for convenience of description, an indoor unit of a ceiling type air conditioner will be described as an example. However, a blade according to an embodiment of the present disclosure can be applied to an indoor unit of another type air conditioner, such as an indoor unit of a stand type air conditioner and an indoor unit of a wall-mounted air conditioner.

Figure 2:
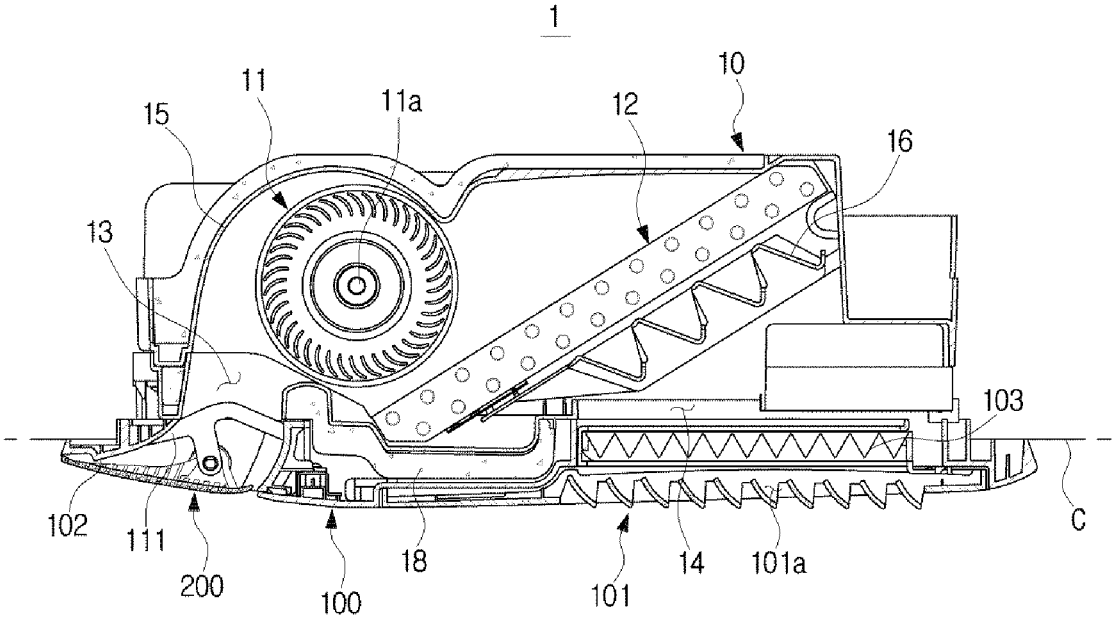
FIG. 2 is a sectional view schematically showing the air conditioner shown in FIG. 1

FIG. 1 is an exploded perspective view of an air conditioner according to an embodiment of the present disclosure, and a blade applied to the air conditioner, and FIG. 2 is a cross-sectional view of the air conditioner shown in FIG. 1.

Referring to FIGS. 1 and 2, an air conditioner 1 according to an embodiment of the present disclosure may include a main body 10 that is hung on or embedded into a ceiling C, and a housing 100 coupled with a lower portion of the main body 10.

The main body 10 may be in the shape of a box, and may include a heat exchanger 12 for heat-exchanging inhaled indoor air with refrigerants, a blower fan 11 for making air flow forcedly, and a control unit (not shown) for controlling operations of the air conditioner 1.

The main body 10 may include an upper plate and side plates forming the front, back, left, and right appearances of the air conditioner 1. The main body 10 may include a scroll portion 15 for guiding air heat-exchanged through the heat exchanger 12 towards an outlet 13.

In the lower portion of the main body 10, an inlet 14 for inhaling indoor air into the inside of the main body 10, and an outlet 13 for discharging heat-exchanged air to the indoor space may be provided. In the outlet 13, a wind-direction control member (not shown) may be provided to adjust the left-right direction of discharged air.

The heat exchanger 12 may include a tube through which refrigerants flow, and a plurality of heat-exchange pins contacting the tube to widen a heat transfer area. The heat exchanger 12 may be inclined to be at nearly right angles to the direction of air flow.

Between the heat-exchanger 12 and the inlet 14, a guide rib 16 may be provided to guide indoor air inhaled into the inside of the main body 10 through the inlet 14 towards the heat exchanger 12. The guide rib 16 may be inclined to be at nearly right angles to the heat exchanger 12.

Below the heat exchanger 12, a drain cover 18 may be provided to collect condensation water generated from the heat exchanger 12. Condensation water collected in the drain cover 18 may be drained to the outside through a drainage hose (not shown).

The blower fan 11 may be rotated by a driving force of a driving motor (not shown) to make air flow forcedly. A rotating shaft 11*a* of the blower fan 11 may be nearly horizontal to the ground. The blower fan 11 may be a crossflow fan.

The housing 100 may include a grill 101 disposed to correspond to the inlet 14 to prevent foreign materials from entering the inside of the main body 10, and a panel outlet 102 disposed to correspond to the outlet 13. In the panel outlet 102, a blade 200 may be rotatably disposed to open or close the panel outlet 102 or to adjust the up-down direction of discharged air. The panel outlet 102, which is formed at the housing 100, may be connected to the outlet 13. Accordingly, in the following description, the outlet 13 and the panel outlet 102 will be collectively called an outlet 102.

The housing 100 may include a filter member 103 for filtering out foreign materials from air entered the inside of the main body 10 through the inlet 14.

If the filter member 103 is used for long periods of time to collect many foreign materials therein, the filter member 103 may need to be cleaned or replaced with new one. In this case, in order to easily detach the filter member 103, the grill 101 may be configured to be opened with respect to the housing 100. The grill 101 may rotate in the state in which it is fixed at and supported on the housing 100 at the rear edge to be opened or closed.

The grill 101 may be disposed in front of the filter member 103 of the housing 100, and at least one portion of the grill 101 may be cut to form a grill inlet 101*a*.

Hereinafter, the housing 100 and the blade 200 according to an embodiment of the present disclosure will be described in detail.

Figure 3:
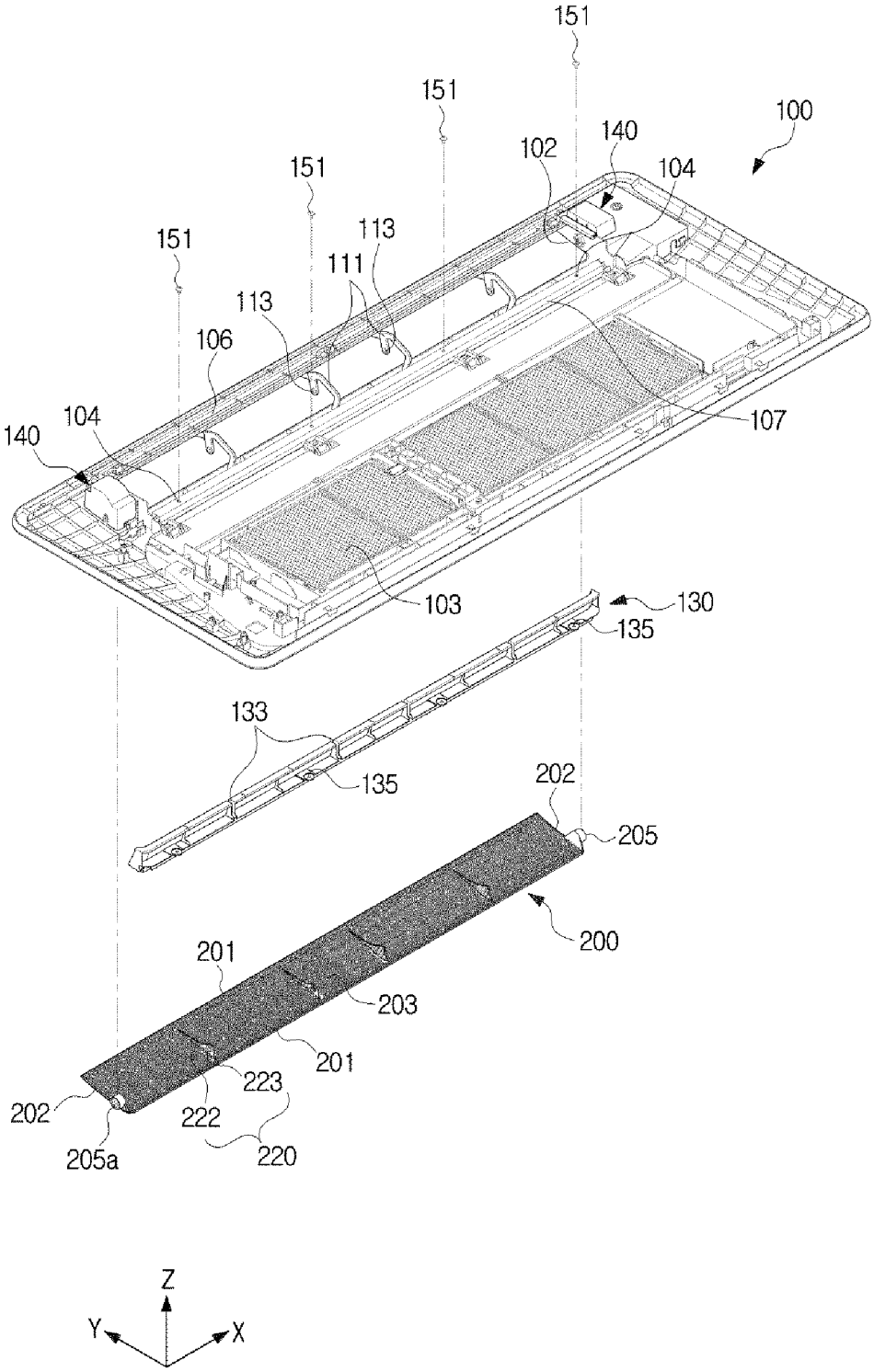
FIG. 3 is an exploded view of the housing and the blade of the air conditioner shown in FIG. 1
Figure 4:
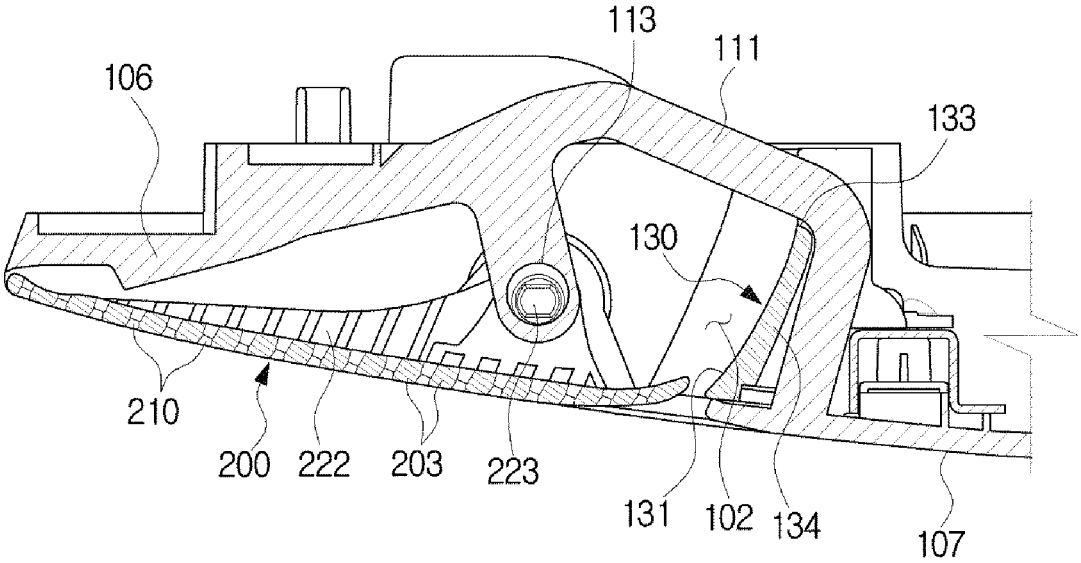
FIG. 4 is a side sectional view of an outlet of the air conditioner shown in FIG. 1

FIG. 3 is an exploded perspective view of a housing, a blade, and an air guide of the air conditioner shown in FIG. 1, and FIG. 4 is a side cross-sectional view of an outlet in which a support member of the air conditioner shown in FIG. 1 is disposed.

The housing 100 may include a plurality of support members 111 for rotatably supporting the blade 200. If the housing 100 includes the plurality of support members 111, the plurality of support members 111 may have the same configuration. However, in order to secure additional stiffness of the housing 100, the plurality of support members 111 may have different shapes according to their positions. However, according to an embodiment of the present disclosure, for convenience of description, the plurality of support members 111 are assumed to have the same shape. Accordingly, one of the support members 111 will be described below.

The support member 111 may extend to connect a front portion 106 of the housing 100 forming a front end of the outlet 102 to a rear portion 107 of the housing 100 forming a rear end of the outlet 102.

The support member 111 may include a blade fixing portion 113. The blade fixing portion 113 may be in the shape of a hole. A coupling portion 223 of a rib 220 of the blade 200, which will be described later, may be rotatably inserted into the blade fixing portion 113.

The support member 111 may connect both ends in width direction (front and back directions in FIG. 1) of the outlet 102. Since the support member 111 connects the front portion 106 of the housing 100 to the rear portion 107 of the housing 100, the front portion 106 of the housing 100, having a relatively short length in the front and back directions, may be prevented from being bent, twisted, or drooping. That is, the support member 111 may reinforce the strength of the front portion 106 of the housing 100.

The blade 200 may be rotatable in the outlet 102. The blade 200 may rotate on the outlet 102 to open or close the outlet 102. The blade 200 may be at a position for closing the outlet 102. Also, the blade 200 may open the outlet 102, and rotate to control a direction in which air blown by the blower fan 11 is discharged from the outlet 102. The blade 200 may rotate within a predetermined angle range to control a direction of air discharged from the outlet 102.

The blade 200 may include the coupling portion 223 that is rotatably inserted into the blade fixing portion 113.

More specifically, the blade 200 may include the rib 220 protruding toward the housing 100, and the rib 220 may include the coupling portion 223 corresponding to the blade fixing portion 113. A plurality of ribs 220 may be provided to correspond to the number of the support members 111. Accordingly, a plurality of coupling portions 223 may be formed to correspond to the number of the support members 111.

The coupling portion 223 may be in the shape of a protrusion to be rotatably inserted into the blade fixing portion 113. The coupling portion 223 may have the substantially same diameter as that of the blade fixing portion 113. A rotation shaft of the coupling portion 223 may be fixed when the blade 200 rotates.

The blade 200 may include a plurality of holes 210 penetrating the blade 200. Air passed to the outlet 102 through the plurality of holes 210 may be discharged to the outside of the housing 100. The plurality of holes 210 may be distributed at regular intervals, which will be described in detail later.

The air conditioner 1 may discharge air through the plurality of holes 210 to discharge the air to the outside of the housing 100 at low speed. Thereby, the purpose of air-conditioning can be achieved without causing a user to directly contact wind. Accordingly, the air conditioner 1 can improve user satisfaction.

At both ends of the blade 200, a driving unit coupling portion 205 may be disposed to be coupled with a blade driving unit 140. If the blade driving unit 140 is disposed only at one end of the blade 200, the driving unit coupling portion 205 may also be disposed only at one end of the blade 200.

The driving unit coupling portion 205 may include a driving unit inserting groove **126*a* into which a portion of the blade driving unit 140 is inserted. In order to enable the blade 200 to receive a rotatory force from the blade driving unit 140, the portion of the blade driving unit 140 inserted into the driving unit inserting groove 126*a* may be in the shape of a polygonal column, and the driving unit inserting groove 126*a* may have a shape corresponding to the polygonal column of the portion of the blade driving unit 140**.

The air conditioner 1 may include an air guide 130 disposed on the outlet 102 and configured to guide air discharged from the outlet 102. The air guide 130 may include a guide surface 131 having a curved shape to guide air. The air guide 130 may be removably coupled with the housing 100 through the outlet 102. The air guide 130 may be assembled with the housing 100 from the bottom to the top through the panel outlet 102

The air guide 130 may include a support member inserting groove 133 into which a portion of the support member 111 is inserted. The support member inserting groove 133 may accommodate a portion of the support member 111 extending along the front-rear direction of the outlet 102.

A front portion of the support member inserting groove 133 may be covered by a cover member 134. Since a portion of the support member 111 extending forward is inserted into the support member inserting groove 133, and a portion of the support member 111 extending backward from the portion inserted in the support member inserting groove 133 is covered by the cover portion 134, an outer appearance of the housing 100 can be improved when the outlet 102 opens.

The air guide 130 may include a fixing portion 135 fixed at the housing 100. By coupling a coupling member 151 with the fixing portion 135 after placing the air guide 130 on the housing 100, the air guide 130 may be fixed at the housing 100.

The air conditioner 1 may include a blade driving unit 140 disposed at both ends of the blade 200 and configured to rotate the blade 200. In FIG. 3, a pair of blade driving units 140 are disposed at both ends of the blade 200, however, a blade driving unit 140 may be disposed at one end of the blade 200. Each blade driving unit 140 may include a driving source and a power transfer member. An elastic member may be disposed between the blade driving unit 140 and the blade 200 to reduce noise and vibrations when the blade 200 rotates.

Hereinafter, an arrangement of the plurality of holes 210 formed in the blade 200 will be descried in detail.

Figure 5:
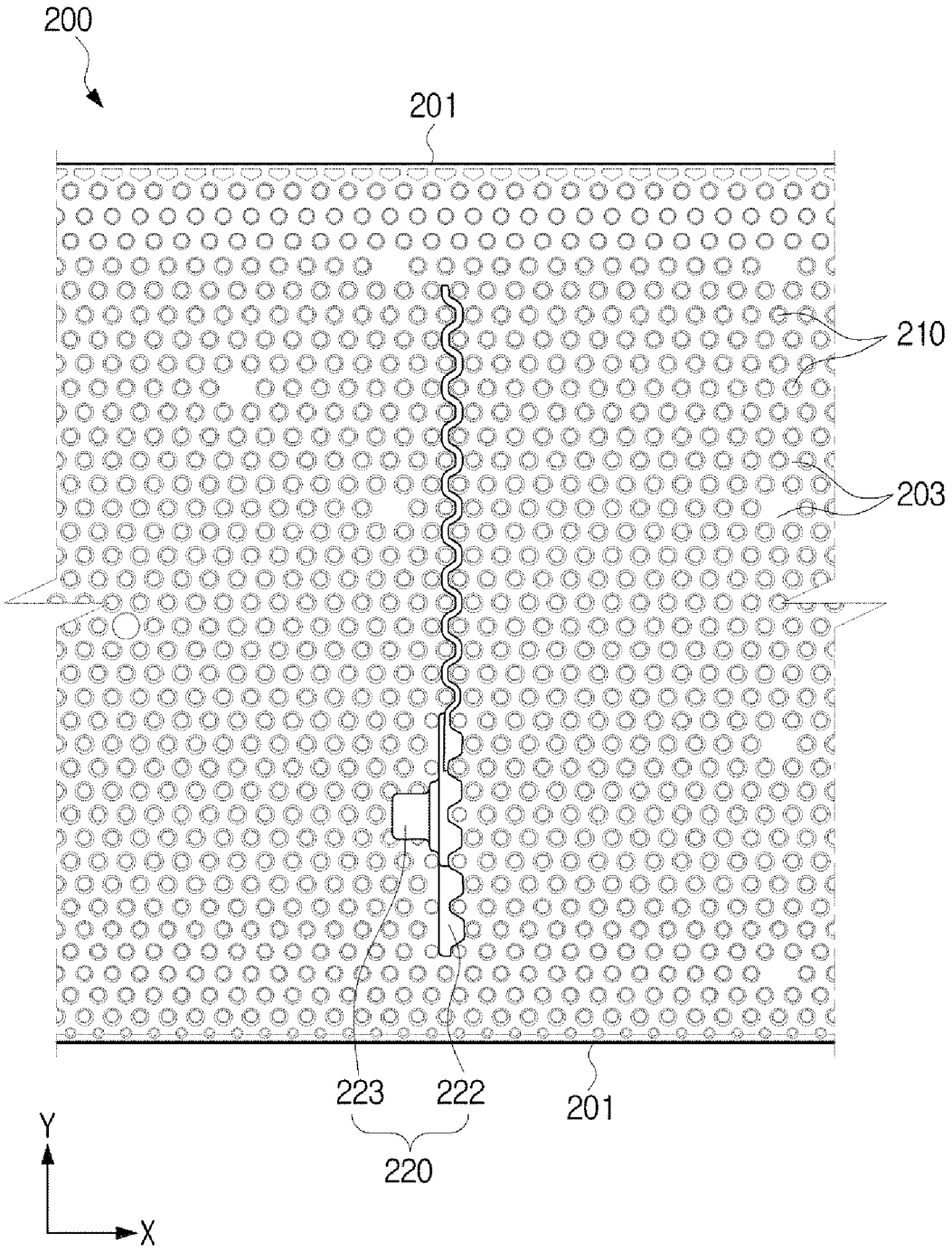
FIG. 5 is an enlarged view of a portion of the blade shown in FIG. 3
Figure 6A:
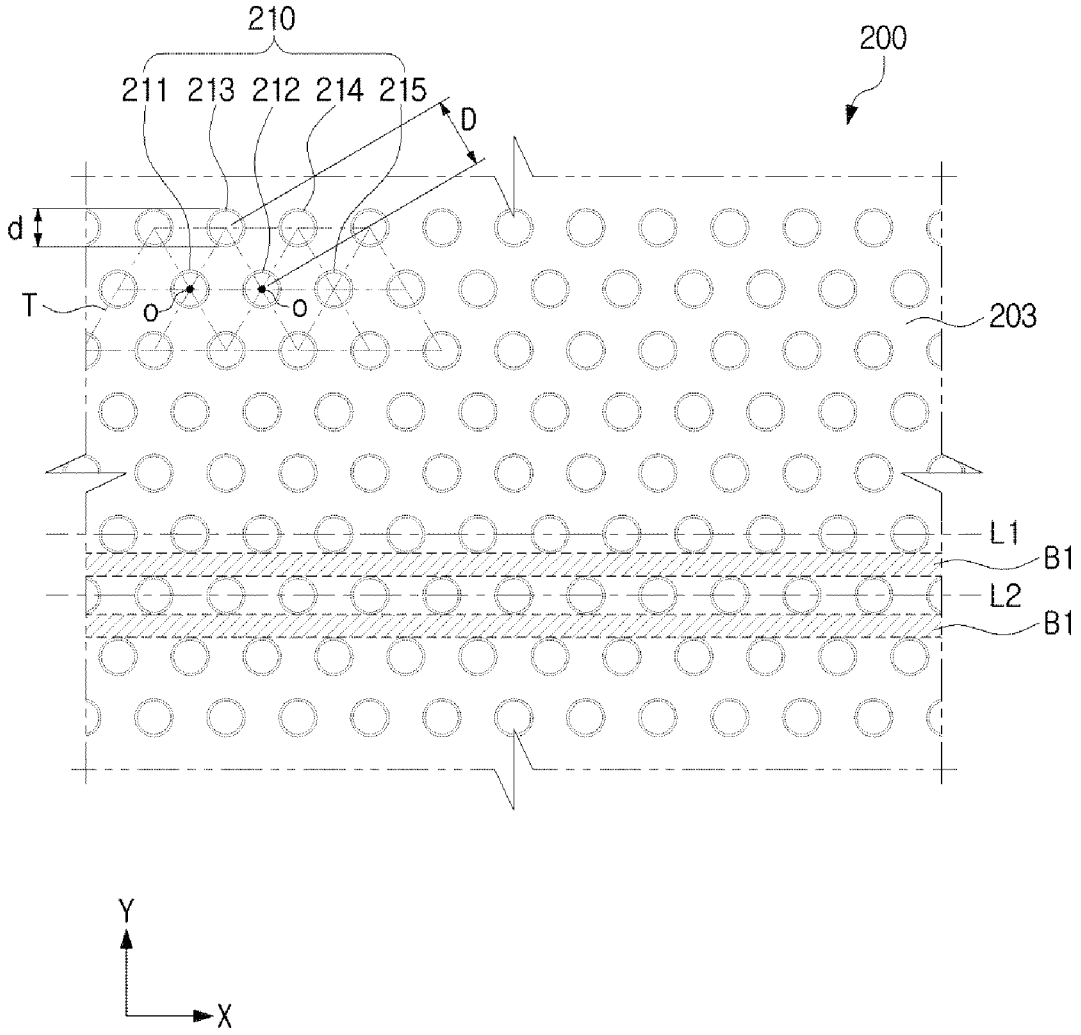
FIGS. 6*a* and 6*b* (6A and 6B) are views schematically showing a part of the blade shown in FIG. 5
Figure 6B:
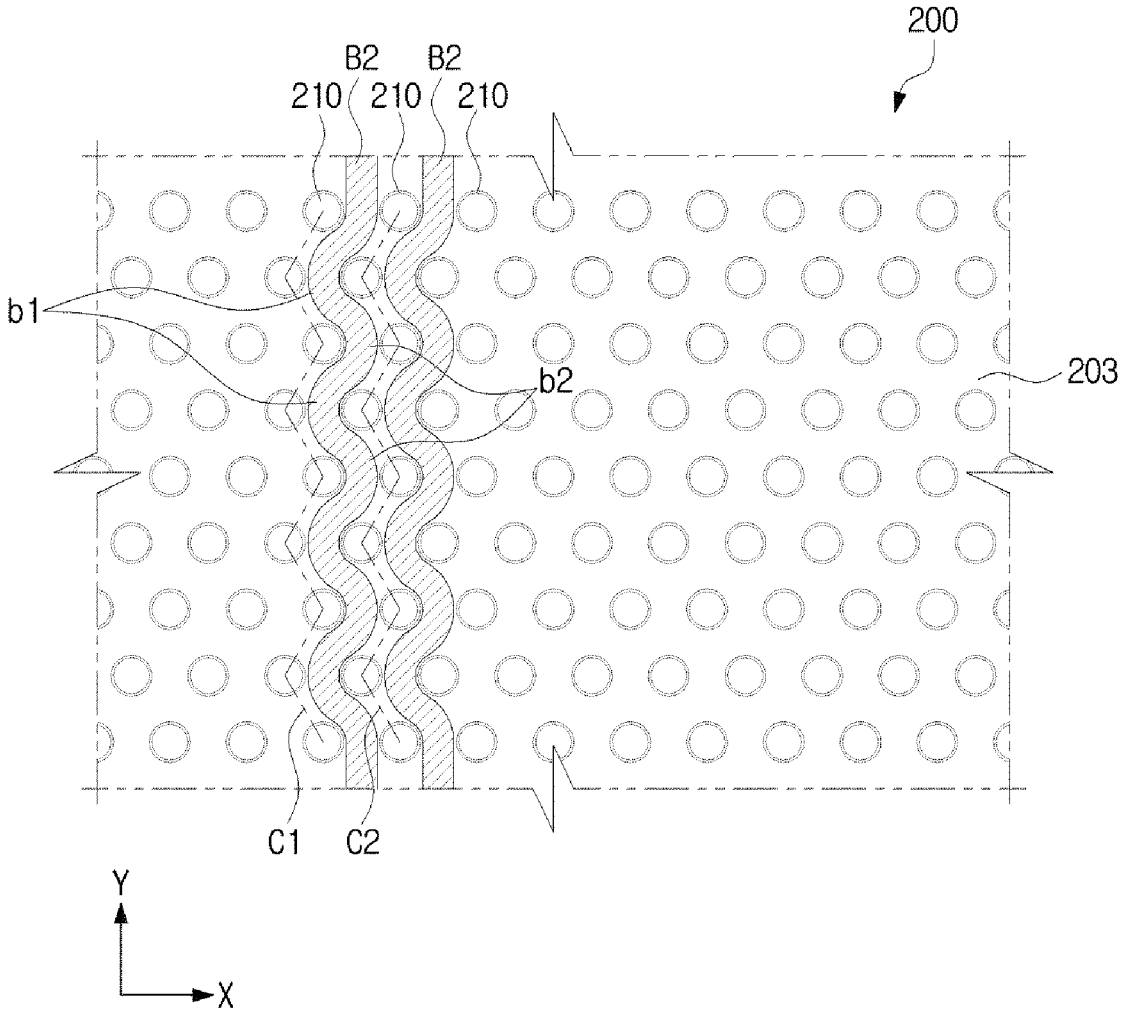
Figure 7:
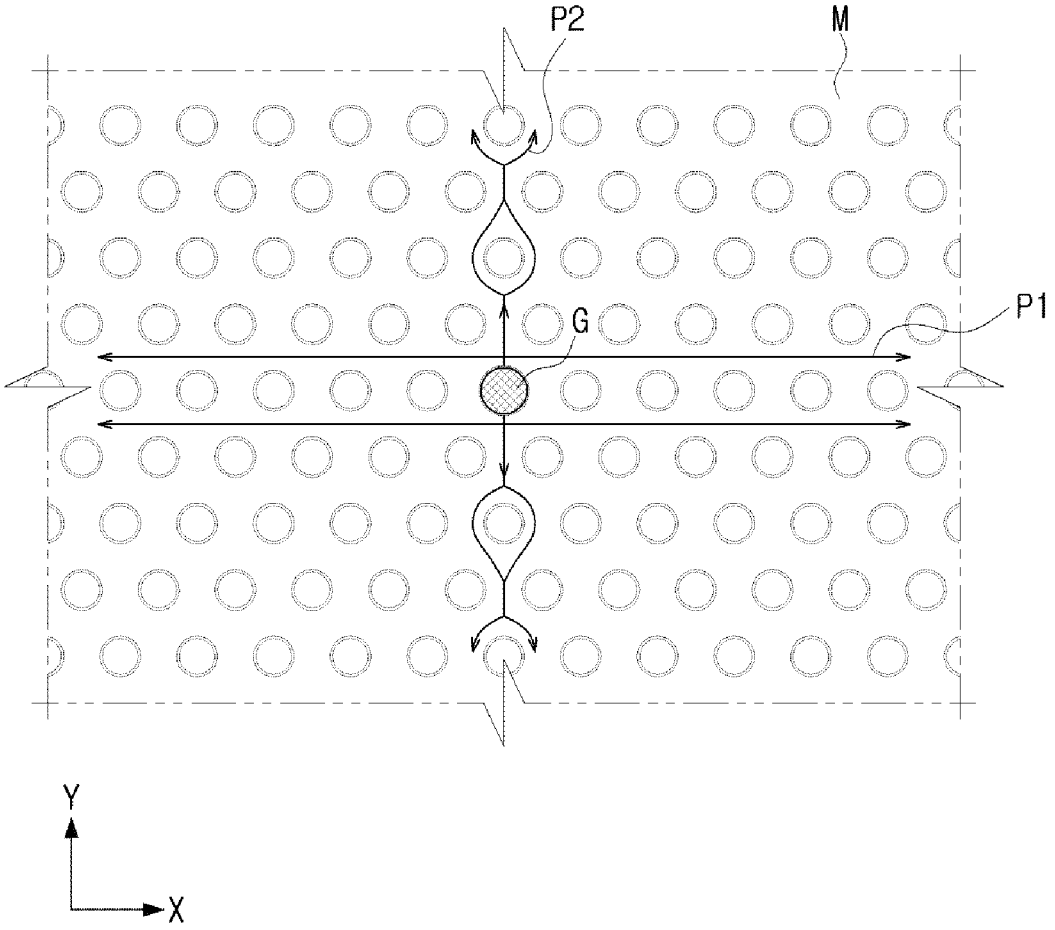
FIG. 7 is a view schematically showing a part of a mold from which the blade shown in FIG. 5

FIG. 5 is an enlarged view of a portion of the blade shown in FIG. 3, FIG. 6 schematically shows a portion of the blade shown in FIG. 5, FIG. 7 schematically shows a portion of a mold for injection-molding the blade shown in FIG. 5, and FIG. 8 schematically shows a portion of the blade shown in FIG. 5.

The blade 200 may include a longer side 201 and a shorter side 202 (see FIG. 3). More specifically, the blade 200 may be in the shape of a rectangle having a pair of longer sides 201 and a pair of shorter sides 202. Hereinafter, for convenience of description, the pair of longer sides 201 and the pair of shorter sides 202 will be referred to as a longer side 201 and a shorter side 202 since the pair of longer sides 201 and the pair of shorter sides 202 are disposed symmetrically. The longer side 201 may be, preferably, 5 times longer than the shorter side 202.

The blade 200 may include a body 203 formed by the longer side 201 and the shorter side 202. As shown in FIG. 5, the plurality of holes 210 may be formed in the blade 200 to penetrate the body 203 of the blade 200. Also, the blade 200 may include a rib 220 for securing the stiffness of the body 203 and coupling the blade 200 with the housing 100.

Air can be discharged out of the housing 100 through the plurality of holes 210 although the blade 200 is at a closed position, as described above.

In order to cool or heat indoor space at minimum wind speed at which a user can feel pleasant, an outlet from which air is discharged needs to have a small size. If the size of the outlet is large, air discharged through the outlet may be blown directly toward the user so that the user may feel displeasure by the discharged air. However, if the size of the outlet is small, an amount of air that is discharged may be reduced, which may result in inefficient indoor air-conditioning.

In order to overcome the problem, a plurality of small-size outlets may be provided to lower wind speed of air that is discharged, while maintaining an appropriate amount of air that is discharged.

In the air conditioner 1 according to an embodiment, the plurality of holes 210 formed in the blade 200 may function as a plurality of outlets described above to maintain a state in which the user can feel pleasant, while air-conditioning an appropriate amount of indoor air. Accordingly, the plurality of holes 210 having a small diameter may be formed by the maximum number that can be formed in the blade 200.

The plurality of holes 210 may have a diameter of about 2 mm or smaller. Air that is discharged through the plurality of holes 210 having a diameter of about 2 mm or smaller may be blown not directly toward the user since the air is discharged at low wind speed.

The plurality of holes 210 may be formed as many as possible. The plurality of holes 210 may be arranged in a predetermined pattern in the body 203 of the blade 200 such that the holes 210 are formed by the maximum number that can be formed in the blade 200.

More specifically, as shown in FIG. 6A, a first hole 211, a second hole 212, and a third hole 213, which are any ones of the plurality of holes 210, may form an equilateral triangle.

The plurality of holes 210 may be arranged successively in the same pattern as the first hole 211, the second hole 212, and the third hole 213 in the blade 200. That is, a fourth hole 214 may be disposed like the third hole 213 forming an equilateral triangle together with the first hole 211 disposed in a direction from the third hole 213 and the second hole 212 spaced from the first hole 211. Accordingly, the second hole 212, the third hole 213, and the fourth hole 214 arranged in the blade 200 may form the same equilateral triangle as that formed by the first hole 211, the second hole 212, and the third hole 213.

Also, a fifth hole 215 may be disposed in a diagonal direction from the fourth hole 214, and accordingly, the second hole 212, the fourth hole 214, and the fifth hole 215 arranged in the blade 200 may form the same equilateral triangle as that formed by the first hole 211, the second hole 212, and the third hole 213.

Since the plurality of holes 210 are disposed in the above-described pattern, the plurality of holes 210 may be formed by the maximum number that can be formed in the body 203 of the blade 200.

A distance D between the plurality of holes 210 may be about twice as long as a diameter d of each hole 210. The distance D may be a distance between the centers O of the plurality of holes 210. A ratio of the diameter d with respect to the distance D may be decided to increase the injection-moldability of the blade 200, while forming the maximum number of holes 210 in the blade 200. This will be described in detail, later.

The plurality of holes 210 may be formed in the blade 200 to form a pattern T of equilateral triangles, as described above. The pattern T of the plurality of holes 210 may include a first line L1 extending in a first direction X, and a second line L2 spaced in a second direction Y from the first line L1 and extending in the first direction X. Both the first line L1 and the second line L2 may extend in the first direction X, so that the first line L1, the second line L2, and the longer side 201 are in parallel to each other.

Also, the pattern T of the plurality of holes 210 may include a third line and a fourth line spaced in the second direction Y and extending in the first direction X, like the first line L1 and the second line L2. However, hereinafter, only the first line L1 and the second line L2 will be described in order to avoid duplication of description.

At least a part of the plurality of holes 210 having the pattern T of equilateral triangles may be arranged along the first line L1 and the second line L2 in the first direction X. That is, the plurality of holes 210 located adjacent to each other in the first direction X may be arranged in parallel to each other in the first direction X.

The blade 200 may include a block area B1 corresponding to an area of the body 203 in which no hole 210 is formed. That is, the block area B1 may be defined as an area of the body 203 in which no hole 210 is formed to prevent air from passing through.

If a block area B located between at least some holes 210 formed along the first line L1 and at least some holes 210 formed along the second line L2 is defined as a first block area B1, the first block area B1 may extend in the first direction X.

The first block area B1 may be in the shape of a rectangle between the first line L1 and the second line L2. The first block area B1 may extend in the first direction X from one shorter side 202 of the blade 202 to the other shorter side 2020. Accordingly, in the inside of the first block area B1, no hole 210 may be formed.

The first block area B1 may also be formed between the third line and the fourth line, as well as between the first line L1 and the second line L2. That is, the first block area B1 may be located between all lines L along which the holes 210 are formed.

The reason why the first block area B1 extends in the direction in which the longer side 201 extends may be to improve the injection-moldability of the blade 200. This will be described in detail, later.

As shown in FIG. 6B, the pattern T of the plurality of holes 210 may include a first column C1 extending in the second direction Y, and a second column C2 spaced in the first direction X from the first column C1 and extending in the second direction Y. Both the first column C1 and the second column C2 may be formed in the insides of equilateral triangles formed symmetrically, and accordingly, the first column C1 may be in parallel to the second column C2.

Also, the pattern T of the plurality of holes 210 may include a third column and a fourth column spaced in the first direction X from the third column and extending in the second direction Y, like the first column C1 and the second column C2. However, hereinafter, only the first column C1 and the second column C2 will be described in order to avoid duplication of description.

At least a part of the plurality of holes 210 having the pattern T of equilateral triangles may be arranged along the first column C1 and the second column C2 in the second direction Y. That is, the plurality of holes 210 located adjacent to each other in the second direction Y may be arranged in zigzags along the second direction Y.

If a block area B located between at least some holes 210 formed along the first column C1 and at least some holes 210 formed along the second column C2 is defined as a second block area B2, the second block area B2 may extend in the second direction Y.

More specifically, the second block area B2 may include, unlike the first block area B1, a plurality of bending portions b bent in the first direction X toward one shorter side or the other shorter side of the blade 200 to correspond to the first column C1 and the second column C2 extending in zigzags, instead of extending in a straight line along the second direction Y.

That is, the second block area B2 may include a plurality of first bending portions b1 extending in the second direction Y and bent in the first direction X toward one shorter side of the blade 200 along the first column C1 and the second column C2, and a plurality of second bending portions b2 extending in the second direction Y and bent in the first direction X toward the other shorter side of the blade 200 along the first column C1 and the second column C2. As described above, since the first column C1 and the second column C2 extend in zigzags, the first bending portions b1 and the second bending portions b2 may be positioned alternately.

In short, the second block area B2 may extend meanderingly in the shape of wave along the second direction Y, and the first block area B1 may extend in a straight line along the first direction X.

The reason why the first block area B1 corresponding to the longer side 201 extends in a straight line, and the second block area B2 corresponding to the shorter side 202 extends meanderingly may be to improve the injection-moldability of the blade 200.

More specifically, as shown in FIG. 7, when the blade 200 is injection-molded, a cavity of a mold M for injection-molding the blade 200 may be in the shape of the block area B. As described above, since the plurality of holes 210 are formed by the maximum number in the blade 200, space where a resin flows in the cavity may be narrowed.

That is, as the number of the plurality of holes 210 increases, the holes 210 may be disposed at shorter distances. Accordingly, space where a resin can flow in the cavity upon injection-molding may be narrowed, resulting in a deterioration of the flowability of the resin and a reduction of the injection-moldability of the blade 200.

Particularly, when the resin flows in the first direction X corresponding to the longer side 201 of the blade 200, a distance to which the resin flows may increase rather than in the second direction Y, resulting in a further deterioration of the flowability of the resin.

In order to prevent the problem, the cavity may be formed such that the first block area B1 is formed in a straight line so as not to prevent a resin from flowing in the first direction X.

When a resin is discharged from a gate G, a flow path P1 of a first resin flowing in the first direction X may be made along space corresponding to the first block area B1.

As described above, since the first block area B1 extends in a straight line along the first direction X, the first resin can flow along the flow path P1 in the first direction X toward both the shorter sides of the blade 200 without any interruption, resulting in improved flowability.

Unlike this, when the resin is discharged from the gate G, a flow path P2 of a second resin flowing in the second direction Y may be made along space corresponding to the second block area B2.

Accordingly, the second resin may flow meanderingly along the flow path P2 in the second direction Y toward both the longer sides of the blade 200, without flowing in a straight line. However, since the flow path P2 of the second resin flowing along the second direction Y is shorter than the flow path P1 of the first resin flowing along the first direction X, the flowability of the second resin may be not greatly lowered although the flow of the second resin is more or less interrupted, so that the overall injection-moldability of the blade 200 is not reduced.

That is, by minimizing limitation of flow in order to cause the first resin to smoothly flow in the direction of the longer side 201 to a relatively long flow distance, the overall injection-moldability of the blade 200 can be improved.

Accordingly, the first block area B1 corresponding to the flow path P1 of the first resin may extend in a straight line along the first direction X, and the second block area B2 corresponding to the flow path P2 of the second resin, having a relatively short distance, may include the plurality of bending portions b.

For this reason, the distance D between the plurality of holes 210 may be about twice as long as the diameter d of each hole 210, as described above. That is, the distance D is decided to secure predetermined space in which a resin can flow in the cavity, thereby improving the injection-moldability of the blade 200.

Figure 8A:
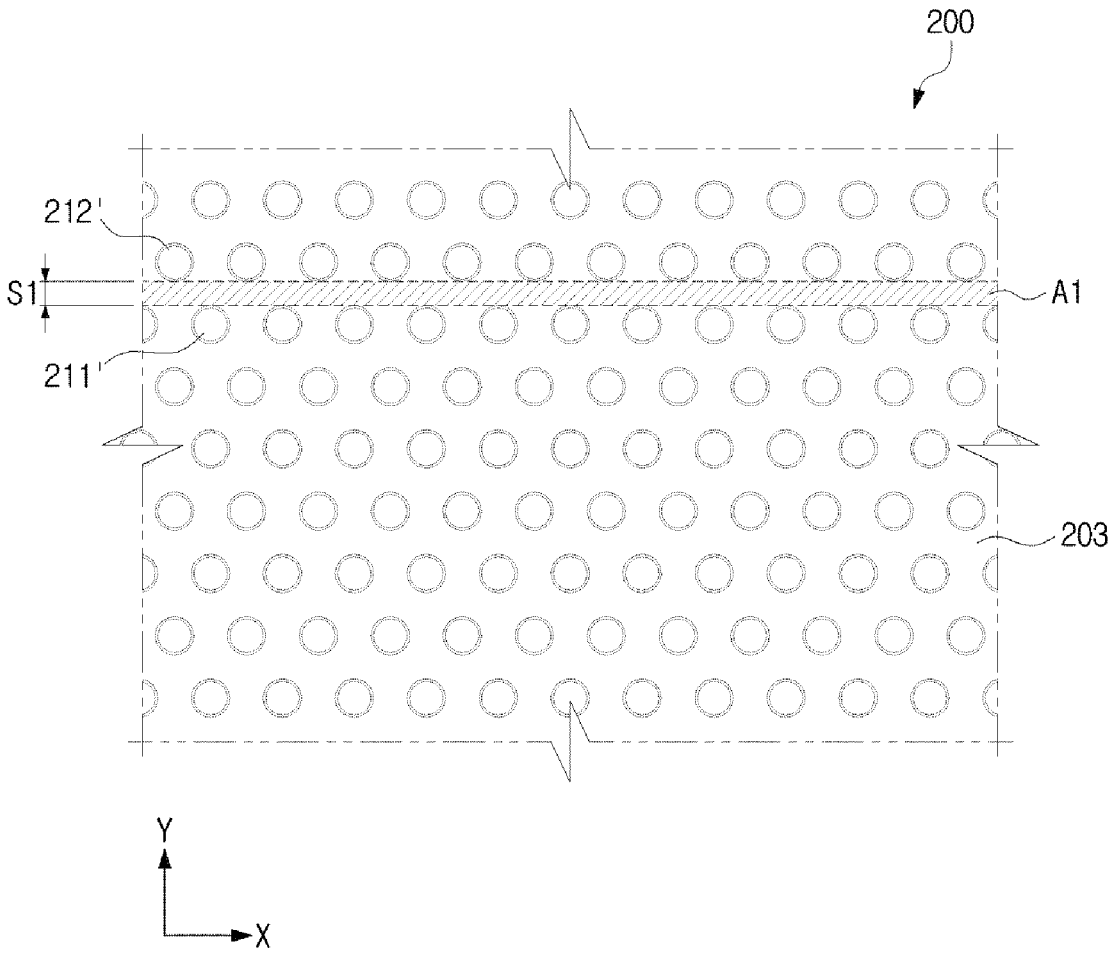
FIGS. 8*a* and 8*b* (8A and 8B) are views schematically showing a part of the blade shown in FIG. 5

In other words, as shown in FIG. 8A, a first hole 211' which is any one among the plurality of holes 210, and a second hole 212' located closest to the first hole 211' in the second direction Y may be spaced with a distance S1 in the second direction Y.

Accordingly, all of the plurality of holes 210 forming the pattern T of equilateral triangles may be arranged with the distance S1 in the second direction Y. Therefore, a first area A1, which is any area formed between the plurality of holes 210 in the second direction Y, may extend in a straight line along the first direction X, wherein no hole 210 is formed in the inside of the first area A1.

In order to injection-mold the blade 200 as shown in FIG. 8A, the mold M shown in FIG. 7 may be provided. Since no hole 210 is formed in the inside of the first area A1, a resin flowing in the first direction X can smoothly flow without any interruption.

Figure 8B:
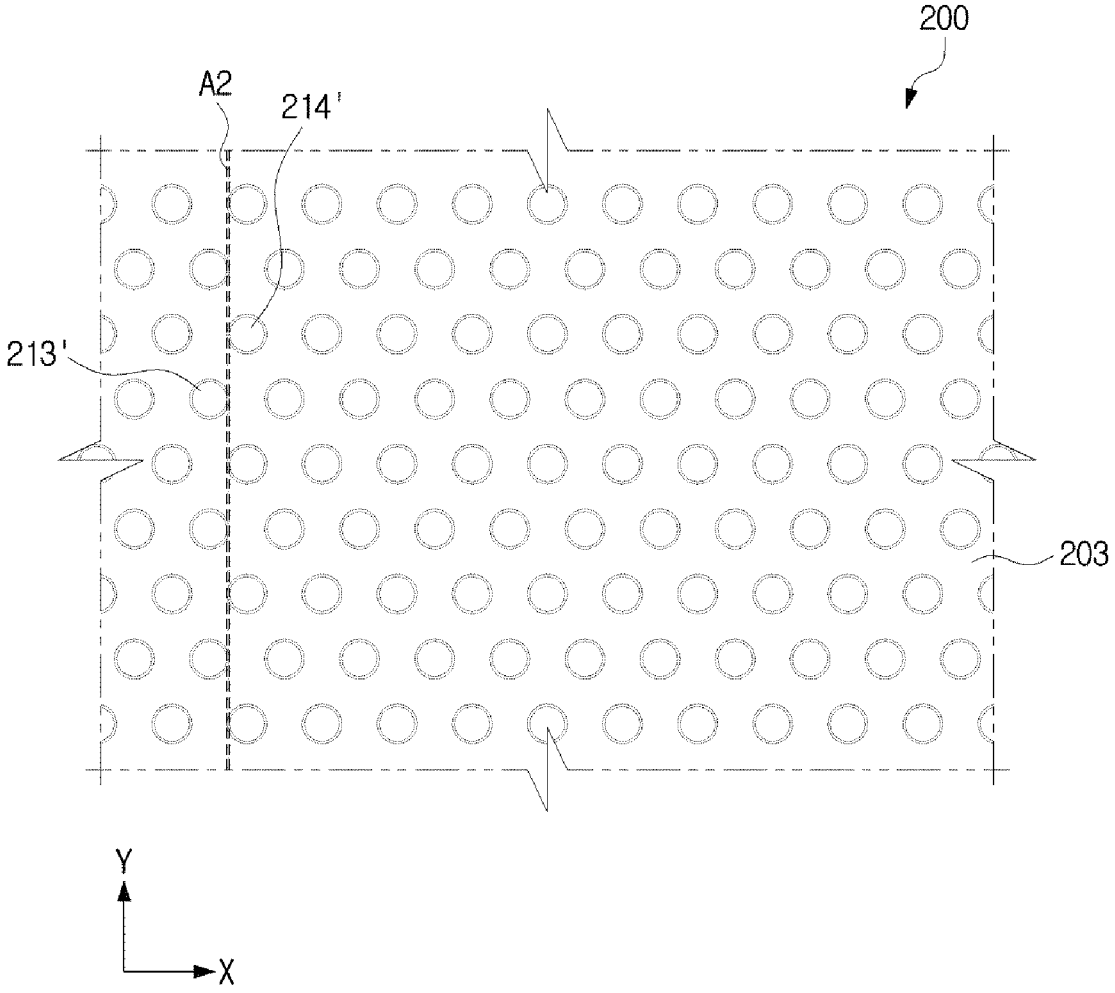

Unlike this, as shown in FIG. 8B, a third hole 213', which is any hole among the plurality of holes 210, may overlap with a fourth hole 214' located closest to the third hole 213' in the first direction, with respect to the first direction X.

That is, at least one area of the third hole 213' may overlap with at least one area of the fourth hole 214' without any spacing with respect to the second direction Y. Accordingly, a plurality of holes 210 adjacent to each other in the second direction Y in the pattern T of equilateral triangles of the plurality of holes 210 may overlap with each other without any spacing.

Accordingly, a second area A2, which is any area formed between the plurality of holes 210 in the first direction X, may extend in a straight line along the second direction Y, and the plurality of holes 210 may be located in the inside of the second area A2, unlike the first area A1.

In order to injection-mold the blade 200 as shown in FIG. 8B, the mold M shown in FIG. 7 may be provided. The plurality of holes 210 may be located in the inside of the second area A2 so that the flow of a resin in the second direction Y is limited to lower flowability. However, since the flow path of the resin flowing in the second direction Y is shorter than that of a resin flowing in the first direction X, as described above, the overall injection-moldability of the blade 200 will be little influenced.

Hereinafter, the rib 220 of the blade 200 will be described.

Figure 9:
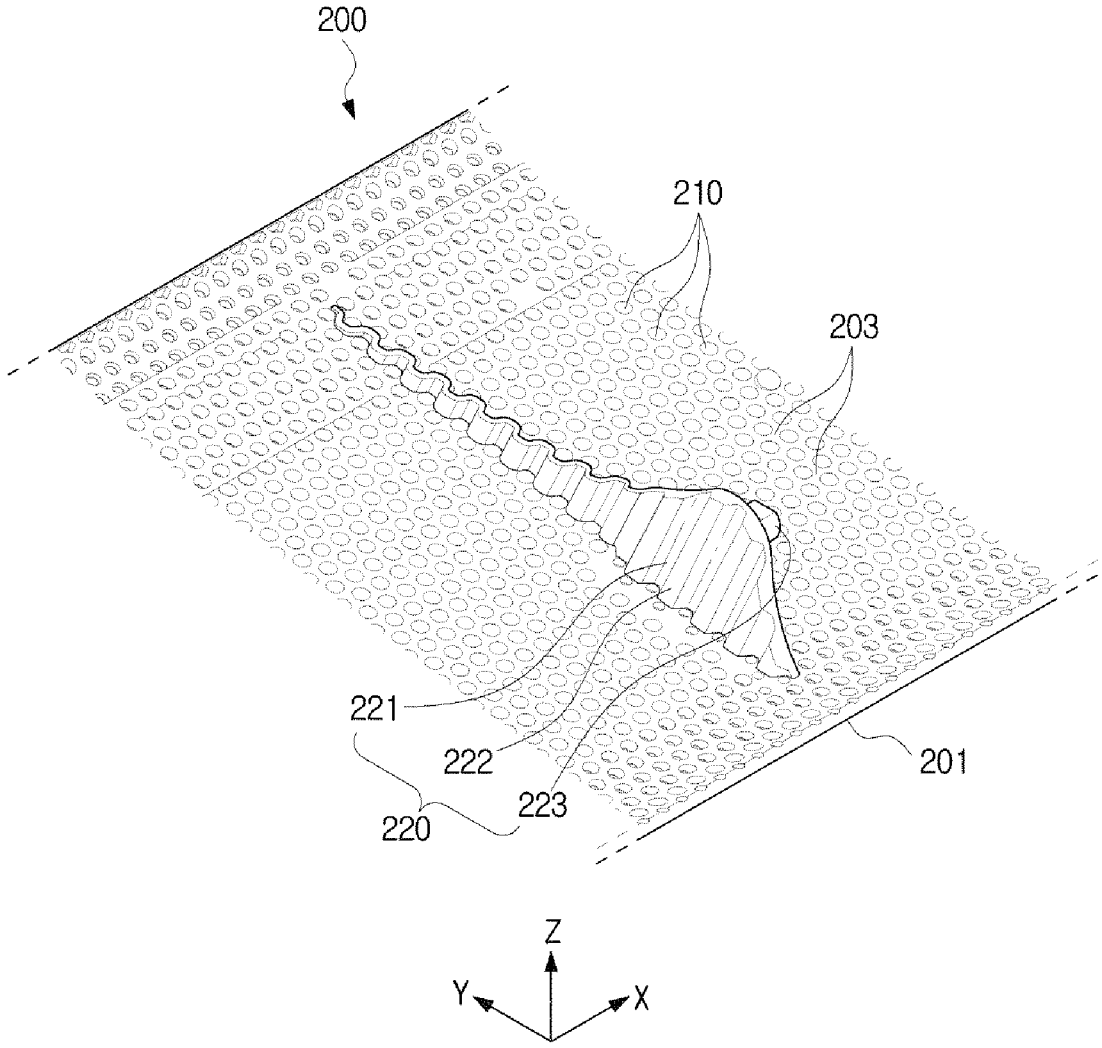
FIG. 9 is a cross-sectional view showing a rib of the blade shown in FIG. 5
Figure 10:
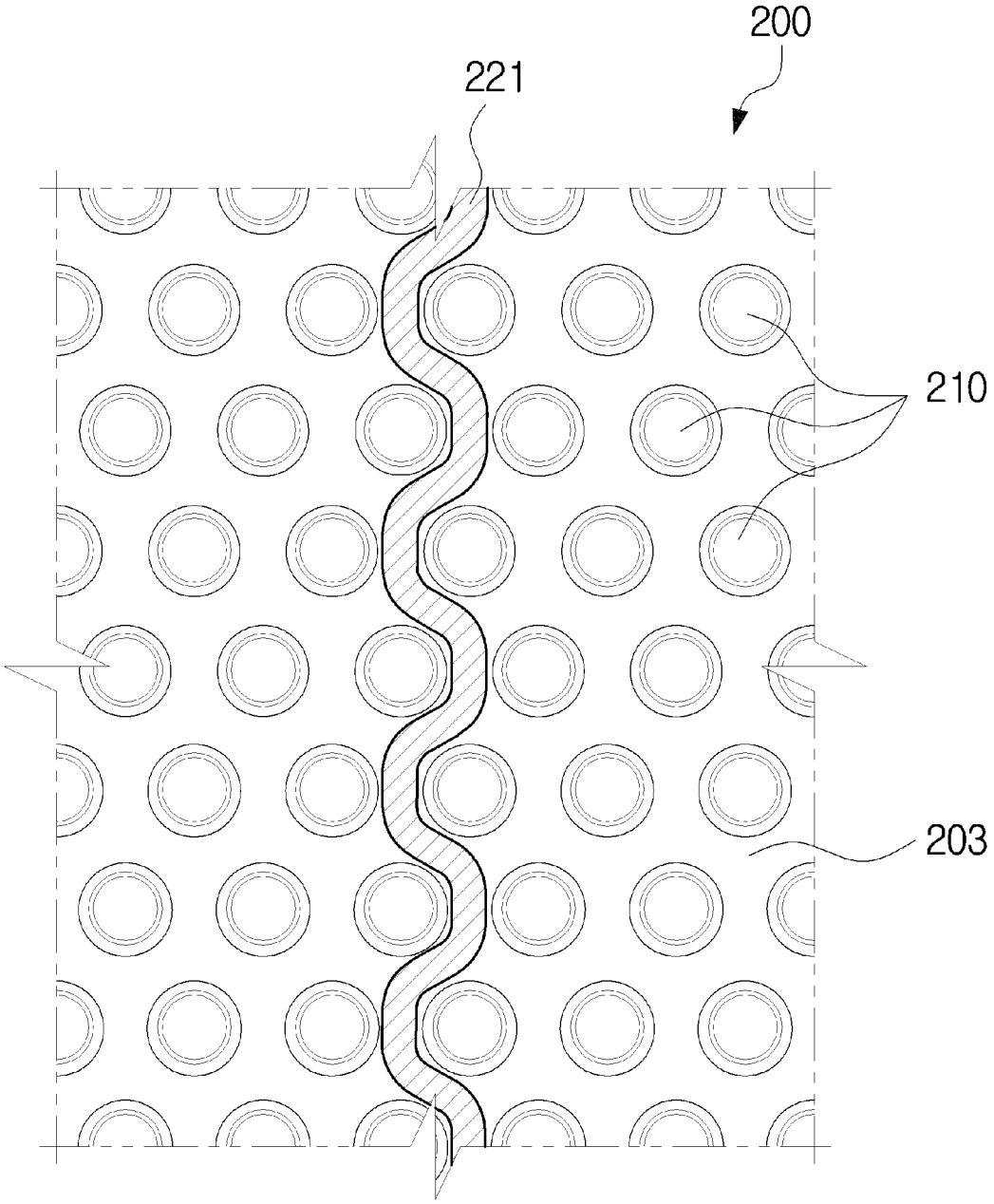
FIG. 10 is a cross-sectional view of the contact portion of the rib of the blade shown in FIG. 9

FIG. 9 is a perspective view of a rib of the blade shown in FIG. 5, and FIG. 10 shows a section of a contact portion of the rib of the blade shown in FIG. 10.

As shown in FIG. 9, the rib 220 may extend in a third direction Z from the blade 200, wherein the third direction Z is perpendicular to the first direction X and the second direction Y of the blade 200. The rib 220 may improve the stiffness of the blade 200 as described above, and include the coupling portion 223 to rotatably couple the blade 200 with the housing 100.

The rib 220 may include a contact portion 221 contacting the body 203, a rib body 222 protruding in the third direction Z from the contact portion 221, and the coupling portion 223 extending from one side of the rib body 222 and coupled with the blade fixing portion 113. The rib 220 may be integrated into the body 203, or separated from the body 203.

A general rib body extends in the shape of a straight line along the third direction Z from a body of a blade. However, according to an embodiment of the present disclosure, since the plurality of holes 210 are formed in the blade 200, the rib 220 may block some of the plurality of holes 210 if it extends in the shape of a straight line from the body 203 along the third direction Z, which deteriorates an opening ratio of the plurality of holes 210, while limiting the flow of air to be discharged through the plurality of holes 210.

In order to prevent the problem, the rib body 222 may be not disposed on areas in which the plurality of holes 210 are formed. More specifically, the rib 200 may have a longer side extending in the second direction Y, and protrude in the third direction Z, wherein the contact portion 221 may be disposed between the plurality of holes 210, as shown in FIG. 10.

Since the rib body 222 extends in the third direction Z from the contact portion 221, the rib body 222 may be disposed without blocking the plurality of holes 210.

In other words, the rib 200 may be disposed on the second block area B2. The second block area B2 may extend in the second direction Y, and no hole 210 may be disposed in the second block area B2. Accordingly, if the contact portion 221 is disposed in the inside of the second block area B2, the rib body 222 may be formed without blocking the plurality of holes 210.

Since the contact portion 221 is disposed in the inside of the second block area B2, the contact portion 221 may include a plurality of bending portions corresponding to the plurality of bending portions b1 and b2 of the second block area B2. That is, the contact portion 221 may have a meandering section, like the second block area B2.

The rib body 222 may protrude in the third direction Z from the contact portion 221, and have a section corresponding to the section of the contact portion 221. Accordingly, the rib body 222 may include a plurality of bending portions, like the contact portion 221, and thus, the rib body 222 may protrude in the third direction Z, while extending meanderingly in the second direction Y. Also, the rib body 222 may extend in the second direction Y in such a way to protrude in the third direction Z with an inclination.

The plurality of bending portions of the rib body 222 may neither limit the flow of air entering the plurality of holes 210 nor block the plurality of holes 210, thereby making air current flow smoothly, which contributes to an improvement in discharge efficiency of the air conditioner 1.

According to a technical concept of the present disclosure, the air conditioner may discharge air through the plurality of holes formed in the blade when the blade is at a closed position of closing the outlet, wherein the plurality of holes may be formed in a predetermined pattern to efficiently discharge air therethrough.

According to another technical concept of the present disclosure, the blade may include the rib for coupling the blade with the housing, and the rib may be formed in a predetermined shape so as not to limit the flow of air to be discharged through the plurality of holes.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing including an outlet;

an air guide removably coupled with the housing and disposed on the outlet to guide air discharged from the outlet; and a blade configured to open and close the outlet, the blade including:

a first side extending in a first direction, a second side extending in a second direction, the first side being longer than the second side, a plurality of holes, a number of the plurality of holes being disposed, respectively, along a first line extending in the first direction and a second line extending in the first direction, the second line being spaced from the first line in the second direction, a block area in which none of the plurality of holes are formed, the block area comprises an area formed in the first direction between the first line and the second line, and a rib including a coupling portion which is formed to extend from the rib and to couple the blade to the housing, the rib being formed on the blade so that one end of the rib is in in contact with the blade and is curved between the plurality of holes and the blade is rotatable about the coupling portion of the rib to open and close the outlet, wherein another end of the rib protrudes toward the housing from the block area in a third direction perpendicular to the first direction and the second direction without overlapping with the plurality of holes, wherein the housing further includes a support member disposed on the outlet to rotatably support the blade, and wherein the air guide is configured to accommodate a portion of the support member extending along the outlet and cover the portion of the support member.

2. The air conditioner according to claim 1, wherein the area comprised in the block area is a first block area, and the first block area is formed throughout and between the first line and the second line.

3. The air conditioner according to claim 1, wherein none of the plurality of holes are formed in the block area that is formed between the first line and the second line.

4. The air conditioner according to claim 1, wherein the first line and the second line are formed in a straight line.

5. The air conditioner according to claim 1, wherein the first line and the second line are formed parallel to the first side.

6. The air conditioner according to claim 1, wherein the number of the plurality of holes are formed on a first column extending in the second direction, and a second column extending in the second direction, respectively, the second column spaced from the first column in the first direction, and the first column and the second column extend in zigzags.

7. The air conditioner according to claim 6, wherein the area comprised in the block area is a first block area, and the block area comprises a second block area formed in the second direction between the first column and the second column, and the second block area comprises a plurality of bending portions bent in the first direction or in an opposite direction of the first direction on which the rib is formed.

8. The air conditioner according to claim 7, wherein the plurality of bending portions include a plurality of first bending portions bent in the first direction, and a plurality of second bending portions bent in the opposite direction of the first direction, and the plurality of first bending portions and the plurality of second bending portions are arranged alternately in the second direction.

9. The air conditioner according to claim 7, wherein the first block area extends in parallel to the first direction.

10. The air conditioner according to claim 7, wherein the rib protrudes from an inside of the second block area.

11. The air conditioner according to claim 10, wherein the one end of the rib is connected to a body of the blade, and wherein the rib comprises:

a rib body formed to protrude in the third direction from a part of the rib connected to the body of the blade, and wherein the coupling portion is formed to protrude from one side of the rib body and is rotatably coupled with the housing to thereby couple the blade to the housing, and the rib body is disposed in the third direction in the inside of the second block area.

12. The air conditioner according to claim 11, wherein the part of the rib connected to the body of the blade is formed along the second block area.

13. The air conditioner according to claim 11, wherein the part of the rib connected to the body of the blade is formed outside a direction in which air is to be discharged through the plurality of holes.

14. The air conditioner according to claim 10, wherein the rib extends in the third direction in correspondence to the plurality of bending portions with respect to the first direction and the second direction.

15. The air conditioner according to claim 1, wherein when the blade is at an open position, the blade guides air to be discharged through the outlet, and when the blade is at a closed position, the blade enables air to be discharged through the plurality of holes.

16. An air conditioner comprising:

a housing including an outlet;

an air guide removably coupled with the housing and disposed on the outlet to guide air discharged from the outlet; and a blade configured to open and close the outlet, the blade including:

a plurality of holes, a first side extending in a first direction, and a second side extending in a second direction, a first hole among the plurality of holes is spaced from a second hole located closest to the first hole, with respect to the second direction, and a rib including a coupling portion which is formed to extend from the rib to couple the blade to the housing, the rib being formed on a block area in which none of the plurality of holes are formed and formed on the blade so that one end of the rib is in in contact with the blade and is curved between the plurality of holes and the blade being rotatable about the coupling portion of the rib to open and close the outlet, wherein another end of the rib protrudes toward the housing from the block area in a third direction perpendicular to the first direction and the second direction without overlapping with the plurality of holes, wherein the housing further includes a support member disposed on the outlet to rotatably support the blade, and wherein the air guide is configured to accommodate a portion of the support member extending along the outlet and cover the portion of the support member.

17. The air conditioner according to claim 16, wherein a third hole among the plurality of holes overlaps with a fourth hole among the plurality of holes that is located closest to the third hole, with respect to the first direction.

18. The air conditioner according to claim 16, wherein the first hole overlaps with the second hole with respect to the first direction.

19. The air conditioner according to claim 16, wherein the rib protrudes in the third direction without overlapping with the plurality of holes.

20. An air conditioner comprising:

a housing including an outlet;

an air guide removably coupled with the housing and disposed on the outlet to guide air discharged from the outlet; and a blade configured to open and close the outlet, the blade including:

a plurality of holes, a first side extending in a first direction, a second side extending in second direction, and a block area in which none of the plurality of holes are disposed, wherein at least a number of the plurality of holes are disposed along a first line extending in the first direction and a second line spaced in the second direction from the first line, respectively, the second line extending in the first direction, the at least number of the plurality of holes are disposed along a first column formed toward the second direction, and a second column spaced in the first direction from the first column, respectively, the second column being formed toward the second direction, and the first line and the second line are formed in a straight line, and the first column and the second column are formed in zigzags, wherein the housing further includes a support member disposed on the outlet to rotatably support the blade, and wherein the air guide is configured to accommodate a portion of the support member extending along the outlet and cover the portion of the support member.

* * * * *